US006340921B1

(12) United States Patent
Kuroda et al.

(10) Patent No.: US 6,340,921 B1
(45) Date of Patent: Jan. 22, 2002

(54) DIELECTRIC FILTER, DIELECTRIC DUPLEXER, AND COMMUNICATION APPARATUS USING THE SAME

(75) Inventors: Katsuhito Kuroda, Mato; Jinsei Ishihara, Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/602,304

(22) Filed: Jun. 23, 2000

(30) Foreign Application Priority Data

Jun. 25, 1999 (JP) ..... 11-179675

(51) Int. Cl.[7] ..... H01P 1/202
(52) U.S. Cl. ..... 333/134; 333/202; 333/206
(58) Field of Search ..... 333/202, 206, 333/134

(56) References Cited

U.S. PATENT DOCUMENTS 5,831,495 A * 11/1998 Hino ..... 333/202

FOREIGN PATENT DOCUMENTS

JP 2001036303 * 2/2001

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric filter and a dielectric duplexer have simple structures, in each of which the resonance frequency of a TE mode is controlled in such a manner that no TE-mode spurious response occurs in a band requiring attenuation. Specifically, the distance between the central position of each of inner-conductor-formed holes and a widthwise line of a dielectric block is set to be two times or more than the distance between the central position of each of the holes and a lengthwise line thereof. With this arrangement, the resonance frequency of a spurious mode such as a $TE_{101}$ mode is shifted to the low-frequency side to deviate the resonance frequency of the spurious mode from a band requiring attenuation, for example, from a band near the second-order harmonic of a TEM mode, as a mode to be used. In addition, a communication apparatus is formed by using one of the filter and the duplexer described above.

4 Claims, 12 Drawing Sheets

DIELECTRIC FILTER, DIELECTRIC DUPLEXER, AND COMMUNICATION APPARATUS USING THE SAME

BACKGROUND OF THE INVENTION

1. Field of the Invention

The present invention relates to dielectric filters and dielectric duplexers used in microwave bands and millimeter-wave bands, and the invention also relates to communication apparatuses using the same.

2. Description of the Related Art

FIG. 15A shows a perspective view of a conventional dielectric filter obtained by forming conductor films on a dielectric block and therein. In this figure, reference numeral 1 denotes a substantially rectangular-parallelepiped dielectric block, in which inner-conductor-formed holes 2*a* and 2*b* having inner conductors 3*a* and 3*b* formed on the inner surfaces thereof are formed. On external surfaces of the dielectric block 1, an outer conductor 4 is each formed. A non-inner-conductor-formed position g is disposed on the inner surface of each of the inner-conductor-formed holes 2*a* and 2*b*. In addition, on the external surfaces of the dielectric block 1, input/output electrodes 5*a* and 5*b* are formed in such a manner that the electrodes 5*a* and 5*b* are isolated from the outer conductors 4.

With this arrangement, TEM-mode dielectric resonators are formed by using the dielectric block, the inner conductors, and the outer conductors. A comb-line coupling between the dielectric resonators is performed by stray capacitances generated at the non-inner-conductor-formed portions g so as to form a dielectric filter constituted of the two-stage resonator as an overall structure.

In the dielectric filter formed by disposing the inner-conductor-formed holes in the substantially rectangular-parallelepiped dielectric block, in order to obtain specified characteristics, the outline dimensions of the dielectric block, the dimensions of the inner-conductor-formed holes, and the positions of the inner-conductor-formed holes disposed inside the dielectric block are determined. Particularly, the unloaded Q of the resonator increases depending on both the thickness tb between the inner-conductor-formed hole and a widthwise line of the dielectric block and the thickness ta between the inner-conductor-formed hole and a lengthwise line of thereof.

FIG. 15B shows the relationship between the ratio of the thickness ta to the thickness tb as the aforementioned two distances and the unloaded Q of the resonator obtained when the length of a widthwise line C of a plane perpendicular to an axis of each of the inner-conductor-formed holes of the dielectric block is set to be 2.0 mm, the length of a lengthwise line H thereof is set to be 4.0 mm, and the axial length D of the inner-conductor-formed hole is set to be 4.0 mm. As shown here, regardless of the width of an inner diameter of each of the inner-conductor-formed hole, the larger the ratio of tb/ta, the higher the unloaded Q of the resonator. In contrast, in a range in which the ratio of tb/ta is larger than 1, almost no increase in the unloaded Q of the resonator can be expected. As a result, in the conventional art, the thickness tb is set to be substantially equal to the thickness ta.

However, in the dielectric filter in which the outer conductor is formed on each of the external surfaces of the substantially rectangular-parallelepiped dielectric block, the arrangement made by the dielectric block and the outer conductors causes a spurious mode such as a $TE_{101}$ mode, other than a TEM mode as a fundamental resonance mode.

Consequently, such a spurious mode becomes problematic when the spurious mode occurs in a band requiring attenuation, for example, a band of a higher-order frequency than the central frequency of a pass band of the dielectric filter. In a conventional dielectric filter, for example, as shown in Japanese Unexamined Patent Application Publication No. 8-51301, a part of an outer conductor formed on a dielectric-block end face closer to a non-conductor-formed portion is cut away to adjust the resonance frequency of a spurious mode, and, then, the spurious-mode frequency is isolated from a TEM-mode resonance frequency so that influence of the spurious mode can be avoided. As a result, since the overall structure of the dielectric filter is complicated, such an arrangement causes a problem of an increase in production cost.

SUMMARY OF THE INVENTION

To overcome the above described problems, preferred embodiments of the present invention provide a dielectric filter and a dielectric duplexer each having a simple structure, in which control can be given in such a manner that no TE-mode spurious response occurs in a band requiring attenuation. Further, the preferred embodiments of the present invention provide a communication apparatus using one of the dielectric filter and the dielectric duplexer.

One preferred embodiment of the present invention provides a dielectric filter and a dielectric duplexer each including a substantially rectangular-parallelepiped dielectric block, a plurality of holes formed inside the dielectric block, the holes aligned in parallel with each other along a lengthwise line of the dielectric block, inner conductors formed on the inner surfaces of the plurality of the holes and outer conductors formed on external surfaces of the dielectric block. In this arrangement, the distance between the central axis of an outermost hole of the aligned holes and a widthwise line of the dielectric block is set to be two times or more than the distance between the central axis of the outermost hole and a lengthwise line thereof.

According to the above described arrangements, since designing of the dielectric block permits the frequency of a spurious mode such as a $TE_{101}$ mode to be shifted to the lower-frequency side, the influence of the spurious mode can be prevented. As a result, since it is unnecessary to cut away a part of the outer conductor formed on the end face of the dielectric block, production cost can be reduced.

Another preferred embodiment of the present invention provides a communication apparatus including one of the dielectric filter and the dielectric duplexer, which may be used in a high-frequency circuit section relating to signal transmission/reception in the communication apparatus.

According to the above described arrangement, the influence of a spurious mode such as a $TE_{101}$ mode can be prevented in the dielectric filter and the dielectric duplexer. As a result, limited frequency bands can be effectively used.

DESCRIPTION OF THE PREFERRED EMBODIMENTS

Referring to FIGS. 1A and 1B to FIG. 4, a description will be given of the structure of a dielectric filter according to a first embodiment of the present invention.

Figure 1A:
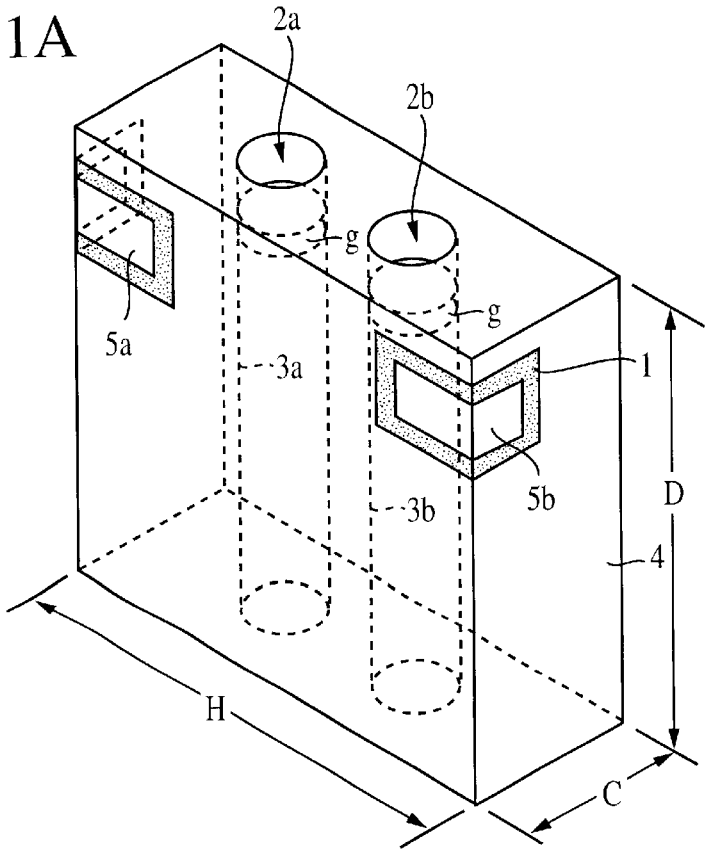
FIG. 1A shows a perspective view of the appearance of a dielectric filter according to a first embodiment of the present invention.
Figure 1B:
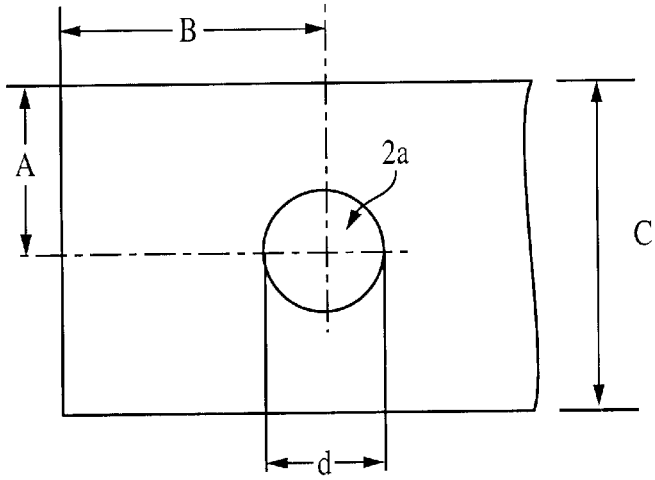
FIG. 1B shows a partial plan view thereof.

FIG. 1A shows a perspective view of a dielectric filter, and FIG. 1B shows a partial plan view of an open face of an inner-conductor-formed hole. As shown in FIG. 1A, in a substantially rectangular-parallelepiped dielectric block 1, inner-conductor-formed holes 2*a* and 2*b* having inner conductors 3*a* and 3*b* formed on the inner surfaces thereof are disposed, and on each of the external six surfaces of the rectangular-parallelepiped dielectric block 1, an outer conductor 4 is disposed. On the inner surfaces of the inner-conductor-formed holes 2*a* and 2*b*, non-inner-conductor-formed portions g are disposed. In addition, on the external surfaces of the dielectric block 1, input/output electrodes 5*a* and 5*b* are disposed in such a manner that the electrodes 5*a* and 5*b* are isolated from the outer conductors 4.

As shown here, the arrangement made by using the dielectric block 1, the inner conductors 3*a* and 3*b*, and the outer conductors 4 forms two TEM-mode dielectric resonators, and stray capacitances occurring at the non-inner-conductor-formed portions g permit comb-line coupling between the two resonators to be performed. With this arrangement, a dielectric filter comprised of the two-stage resonator is formed.

In this arrangement, regarding the outline dimensions of the dielectric block, a lengthwise line of the dielectric block 1 is indicated by the symbol H and a widthwise line thereof is indicated by the symbol C, with the axial length D thereof, the distance B from the center of the inner-conductor-formed hole 2*a* to the widthwise line C of the dielectric block, the distance A from the center of the inner-conductor-formed hole 2*a* to the lengthwise line H of the dielectric block, and the width d of the inner diameter of the inner-conductor-formed hole 2*a*. In this situation, a $TE_{101}$-mode resonance frequency $f_s$ expressed by using $TE_{DCH}$ is determined by the following equation:

$$fs = \sqrt{\left(\frac{1}{2\times D\times\sqrt{\varepsilon r}}\right)^2 + \left(\frac{0}{2\times C\times\sqrt{\varepsilon r}}\right)^2 + \left(\frac{1}{2\times H\times\sqrt{\varepsilon r}}\right)^2} \times Co \qquad \text{[EQUATION 1]}$$

In the above equation, $C_o$ represents the velocity of light, and $\epsilon_r$ represents a relative permittivity of the dielectric block.

Figure 2:
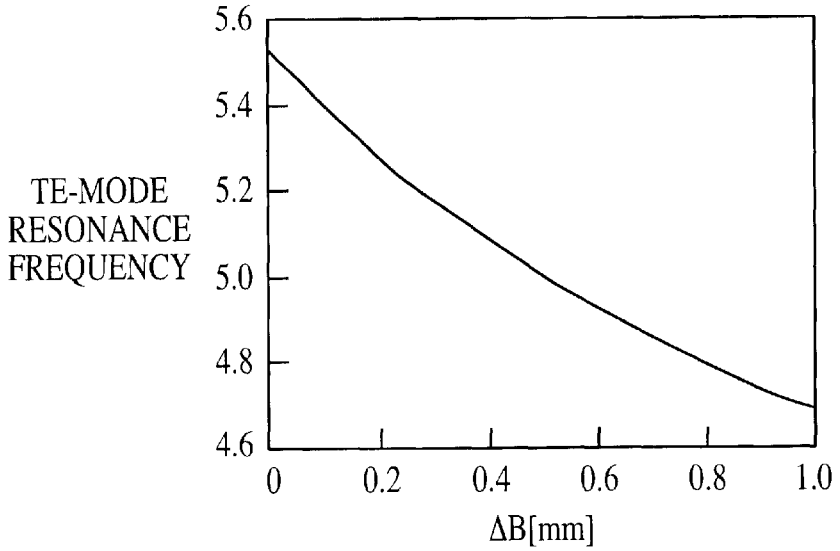
FIG. 2 is a graph showing an example of changes in a resonance frequency of a TE mode with respect to changes in the dimension B of the dielectric filter.

When the dimension B is changed while the distance between the two inner-conductor-formed holes 2*a* and 2*b* shown in FIGS. 1A and 1B remains fixed, the dimension H also changes. FIG. 2 shows the relationship between the amount of changes in the dimension B and the amount of changes in the $TE_{101}$-mode resonant frequency. In this case, the dimension H is 4.0 mm, the dimension C is 2.0 mm, the dimension D is 4.0 mm, the distance A is 1.0 mm, and the inner-diameter width d is 1.0 mm. When the distance B is equal to 1.0 mm, AB is equal to zero.

As shown here, the greater the distance B between the center of each of the inner-conductor-formed holes 2*a* and 2*b* and the widthwise line C of the dielectric block, the lower the $TE_{101}$-mode resonance frequency.

Figure 3:
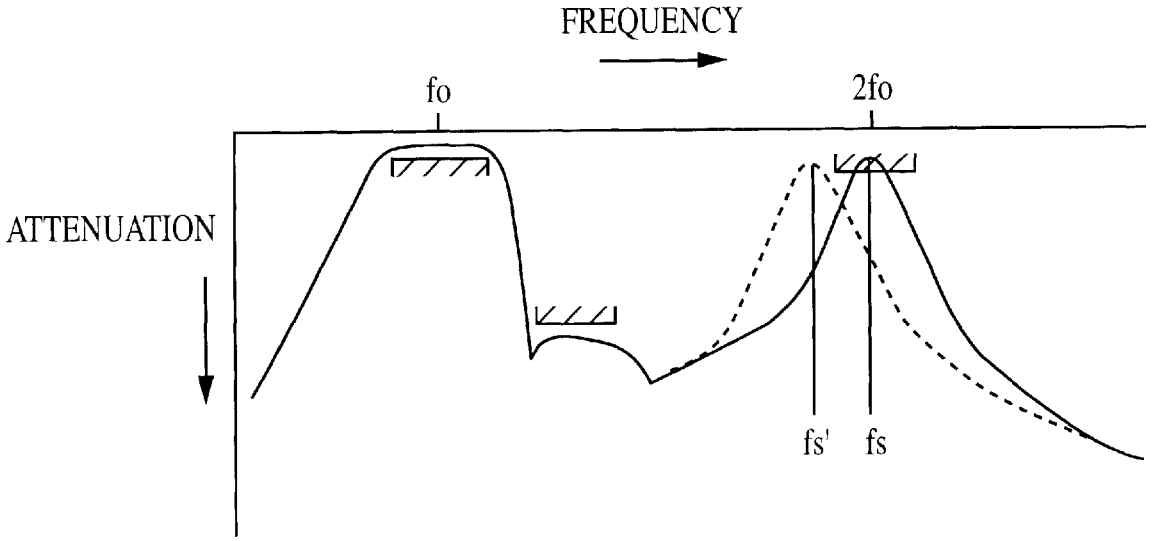
FIG. 3 is a graph showing the pass characteristics of the dielectric filter.

FIG. 3 shows the pass characteristics of the dielectric filter. In this figure, the symbol $f_0$ represents the TEM-mode resonance frequency obtained by the inner-conductor-formed holes, the dielectric block, and the outer conductors shown in FIG. 1A. In the pass characteristics of the dielectric filter, the TEM-mode resonance frequency is a central frequency and a specified bandwidth is set as a pass band. In addition, an attenuation pole appearing on the high-frequency side of the pass band is equivalent to an attenuation pole produced by the comb-line coupling of the above two resonators. The symbol $f_s$ represents the above $TE_{101}$-mode resonance frequency. When the distance B is increased, the resonance frequency $f_s$ is shifted to a direction indicated by the symbol $f_{s''}$. As shown in FIG. 3, when the band in the vicinity of a harmonic $2f_0$ of the central frequency $f_0$ in the pass band is set as a band requiring attenuation, responses of the harmonic $2f_0$ in the frequency band can be suppressed by shifting the $TE_{101}$-mode resonance frequency to the lower-frequency side.

Figure 4:
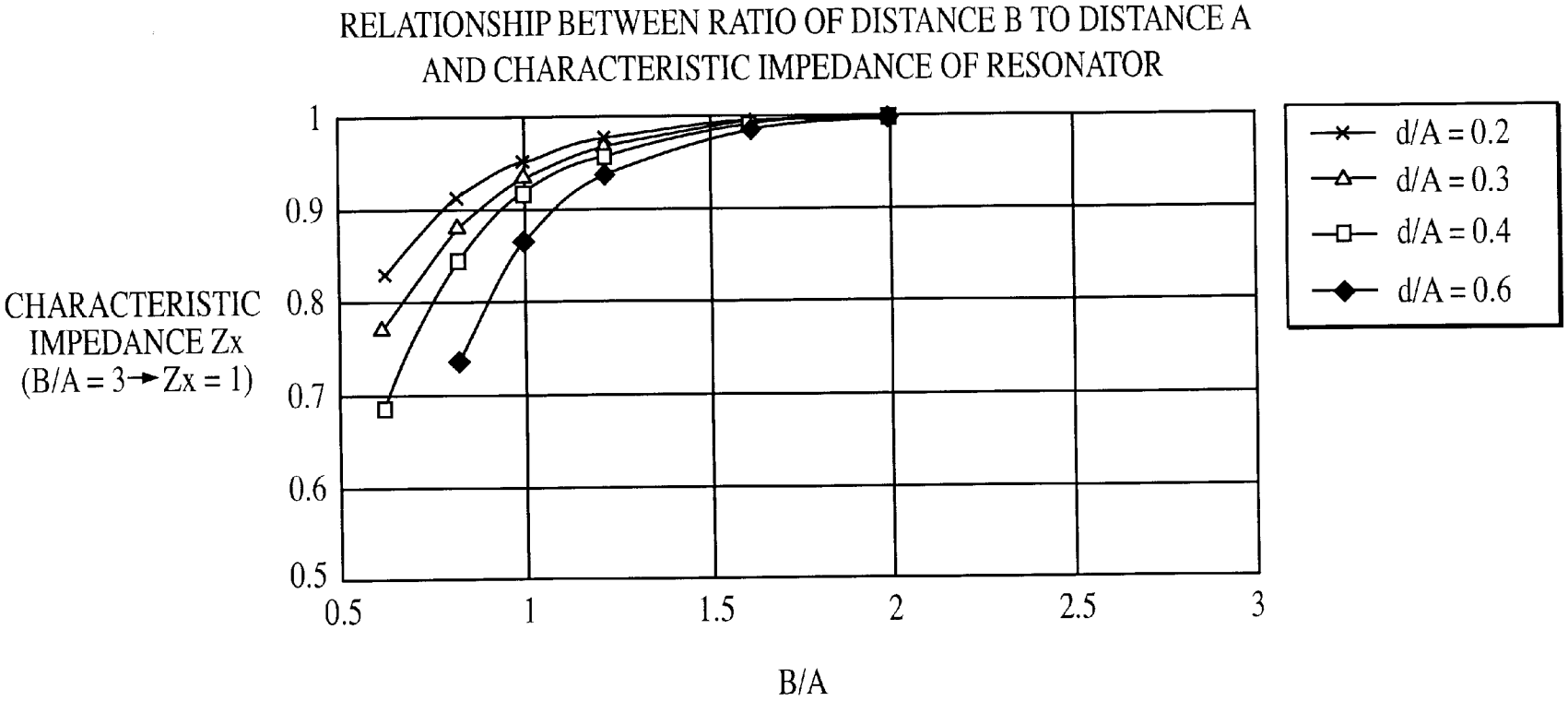
FIG. 4 is a graph showing the relationship between the dimension ratio of B/A and the characteristic impedance of a resonator in the dielectric filter.

FIG. 4 shows the relationship between the ratio of the dimension B to the dimension A and the characteristic impedance Zx of a resonator. Regardless of the inner-diameter width d of an inner-conductor-formed hole, when the ratio of B/A is 2 or larger, the characteristic impedance Zx of the resonator hardly changes. As a result, it is found that increases in the dimension B give no influence on the characteristic impedance. Therefore, in the present invention, since the ratio of B/A is 2 or larger, without giving any influence on the characteristic impedance of the resonator, the $TE_{101}$-mode resonance frequency can be appropriately determined as required.

Figure 5A:
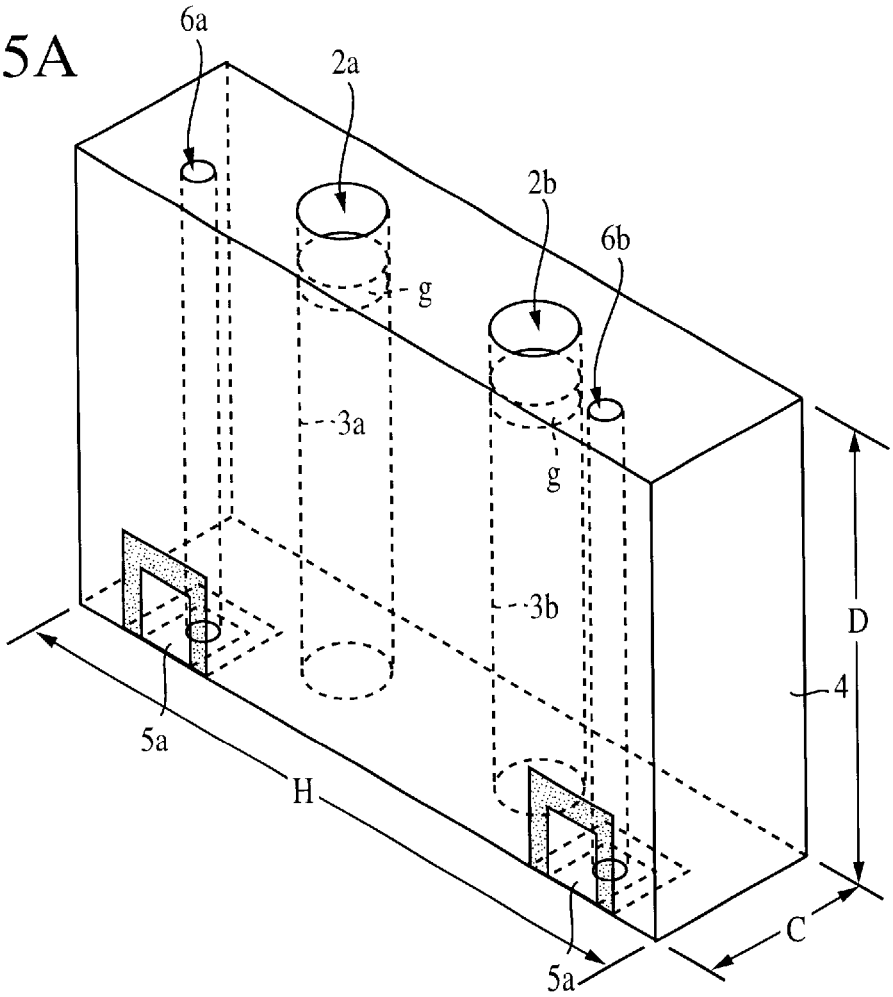
FIG. 5A shows a perspective view of the appearance of a dielectric filter according to a second embodiment of the present invention.
Figure 5B:
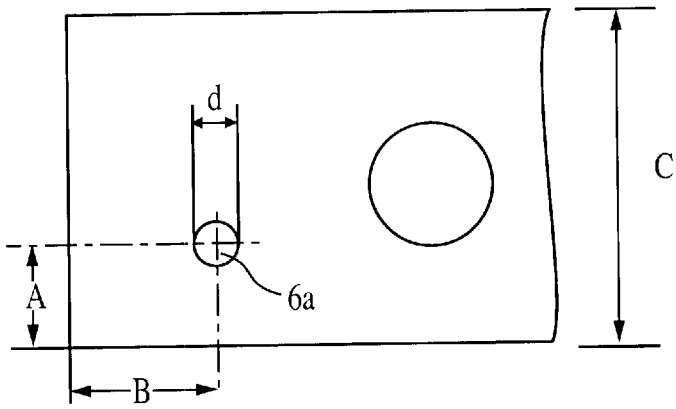
FIG. 5B shows a partial plan view thereof.
Figure 6:
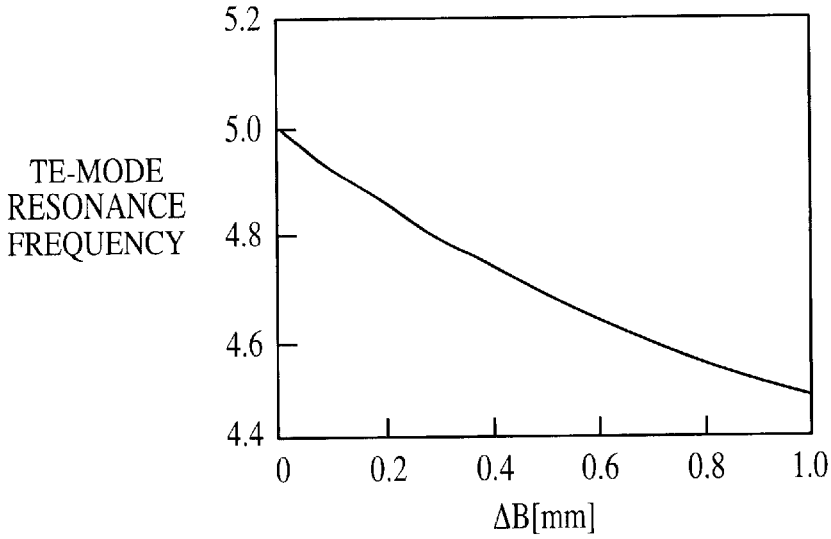
FIG. 6 is a graph showing the relationship between changes in the resonance frequency of a TE mode and changes in the dimension B of the dielectric filter of the second embodiment.

Referring to FIGS. 5A and 5B, and FIG. 6, a description will be given of the structure of a dielectric filter according to a second embodiment of the present invention.

FIG. 5A shows a perspective view of the dielectric filter, and FIG. 5B shows a partial plan view of the open face of an inner-conductor-formed hole. As shown in FIG. 5A, in a substantially rectangular-parallelepiped dielectric block 1, inner-conductor-formed holes 2*a* and 2*b* having inner conductors 3*a* and 3*b* formed on the inner surfaces thereof and excitation holes 6*a* and 6*b* having conductors formed on the inner surfaces thereof are formed in parallel with each other. An outer conductor 4 is each formed on the external six surfaces of the dielectric block 1, and non-inner-conductor-formed portions g are formed on the inner surfaces of the inner-conductor-formed holes 2*a* and 2*b*. On the external surfaces of the dielectric block 1, input/output electrodes 5*a* and 5*b* are formed such that the electrodes 5*a* and 5*b* are isolated from the outer conductors 4. One end of each of the excitation holes 6*a* and 6*b* is connected to the input/output electrodes 5*a* and 5*b*, and the other end of each of the excitation holes 6*a* and 6*b* is connected to the outer conductor 4 in the open faces thereof.

In this way, the two TEM-mode dielectric resonators are formed by the dielectric block 1, and the inner conductors 3*a* and 3*b*, and the outer conductors 4. Stray capacitances generated at the non-conductor-formed portions g permit comb-line coupling between the resonators to be performed. In addition, the resonator comprised of the inner conductor 3*a* and the electrode of the excitation hole 6*a* are interdigitally coupled, and similarly, the resonator comprised of the inner-conductor 3*b* and the electrode of the excitation hole 6*b* are interdigitally coupled.

As shown here, in the structure in which each of the excitation holes is used to obtain an external coupling as an interdigital coupling, since each of the excitation holes is disposed at the outermost position of the dielectric block, the magnitude of the external coupling can be controlled by the distance between each of the excitation holes and each of the resonators regardless of the length of the dimension B. As a result, freedom in the magnitude of the dimension B is increased.

FIG. 6 shows the relationship between the amount of changes in the dimension B and the $TE_{101}$-mode resonance frequency of obtained when the dimension B is changed while the distance between the two inner-conductor-formed holes 2*a* and 2*b* and the distance between the excitation holes 6*a* and 6*b* and the inner-conductor-formed holes 2*a* and 2*b* shown in FIGS. 5A and 5B remain fixed. In this case, an arrangement is made such that the dimension H is 5.0 mm, the width C is 2.0 mm, the height D is 4.0 mm, the inner-diameter width d of the inner-conductor-formed hole 2*a* is 1.0 mm, the distance A is 0.75 mm, and the inner-diameter width d of the excitation hole 6*a* is 0.5 mm. When the distance B is 0.75 mm, this shows that AB is equal to zero.

As shown in FIG. 6, the greater the distance B between the center of the excitation hole and the widthwise line C of the dielectric block, the smaller the $TE_{101}$-mode resonance frequency.

Similar to the case of FIG. 4, in the structure shown in FIGS. 5A and 5B, when the ratio of the distance B between the center of the excitation hole and the widthwise line of the dielectric block to the distance A between the center of the excitation hole and the lengthwise line of the dielectric block is changed, the characteristic impedance of the excitation hole hardly changes when the ratio of B/A is 2 or larger, regardless of the inner-diameter width d of the excitation hole, and increases in the dimension B thereby give no influence on the characteristic impedance thereof. In this invention, since the ratio of B/A is 2 or larger, without giving any influence on the characteristic impedance of the excitation hole, the $TE_{101}$-mode resonance frequency can be appropriately determined as required.

Figure 7:
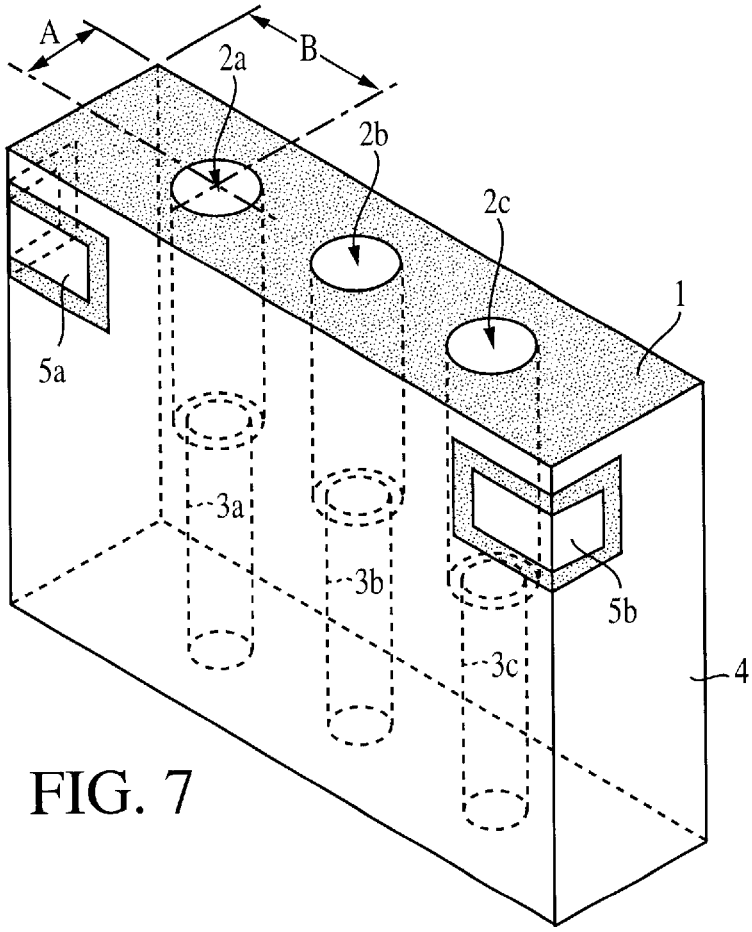
FIG. 7 is a perspective view of the appearance of a dielectric filter according to a third embodiment of the present invention.

FIG. 7 is a perspective view of the appearance of a dielectric filter according to a third embodiment of the present invention. In a substantially rectangular-parallelepiped dielectric block 1, three inner-conductor-formed holes 2*a*, 2*b*, and 2*c* are disposed, and on the external surfaces of the dielectric block 1, an outer conductor 4 is each formed. Unlike the cases of the first and second embodiments, an open face of each of inner-conductor-formed holes 2*a* to 2*c* of the dielectric block 1 is used as an open-circuited end. In addition, the inner-conductor-formed holes 2*a* to 2*c* are stepped holes in which the widths of the inner diameters of the holes on the open-circuited-end sides differ from those on the short-circuited-end sides. As shown here, in the structure in which one end face of the dielectric block is open-circuited, the value of the $TE_{101}$-mode resonance frequency is close to approximately one half that of the case of the dielectric block having both ends short-circuited.

Figure 8:
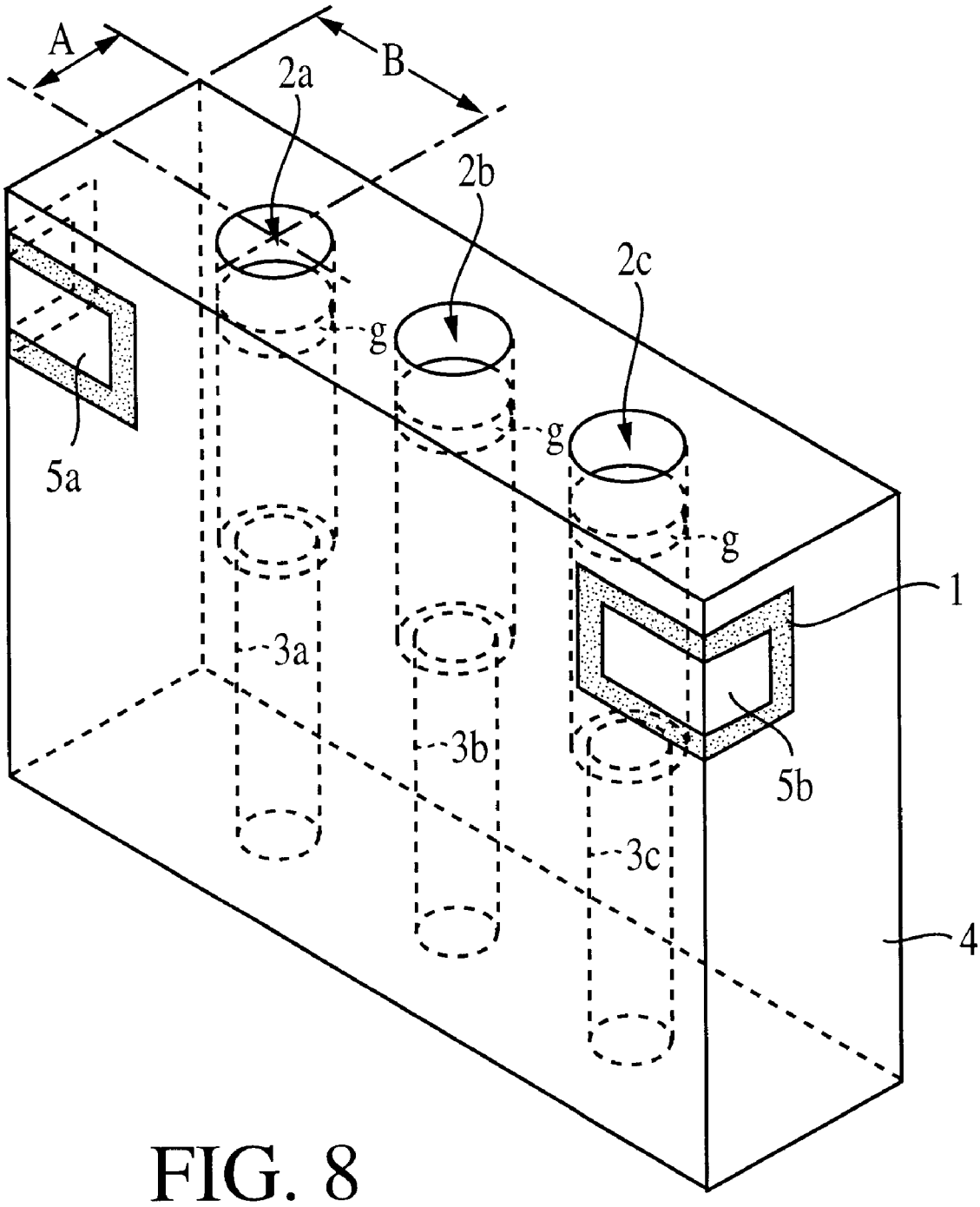
FIG. 8 is a perspective view of the appearance of a dielectric filter according to a fourth embodiment of the present invention.

FIG. 8 is a perspective view of the appearance of a dielectric filter according to a fourth embodiment. In this embodiment, a three-stage resonator is formed by using the resonator of the dielectric filter shown in FIG. 1A, and stepped holes are used as inner-conductor-formed holes. Similar to the case of the first embodiment, the distance B between the center of each of the outermost inner-conductor-formed holes 2*a* and 2*c* and each of the widthwise lines of a dielectric block is set to be two times or greater than the distance A between the center of each of the outermost holes 2*a* and 2*c* and each of the lengthwise lines of the dielectric block.

Figure 9:
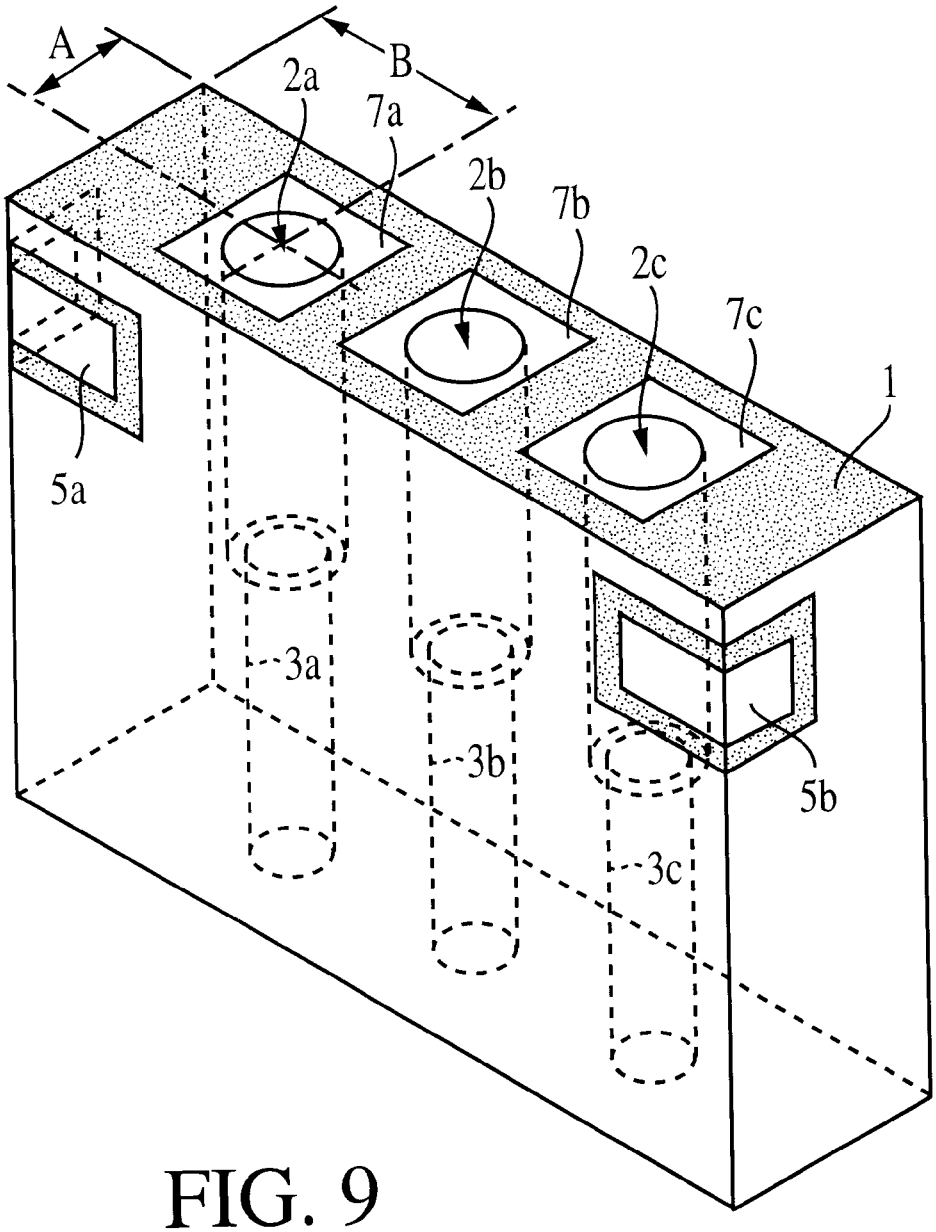
FIG. 9 is a perspective view of the appearance of a dielectric filter according to a fifth embodiment of the present invention.

FIG. 9 is a perspective view of the appearance of a dielectric filter according to a fifth embodiment of the present invention. In this embodiment, an open face of each of inner-conductor-formed holes 2*a* to 2*c* of a dielectric block 1 is used as an open-circuited face, on which coupling electrodes 7*a* to 7*c* extending from inner conductors 3*a* to 3*c* are formed. This arrangement permits capacitive couplings between adjacent resonators to be performed. Similarly, in this case, the distance B between the center of each of the outermost inner-conductor-formed holes 2*a* and 2*c* and each of the widthwise lines of a dielectric block is set to be two times or greater than the distance A between the center of each of the holes 2*a* and 2*c* and each of the lengthwise lines thereof.

Figure 10:
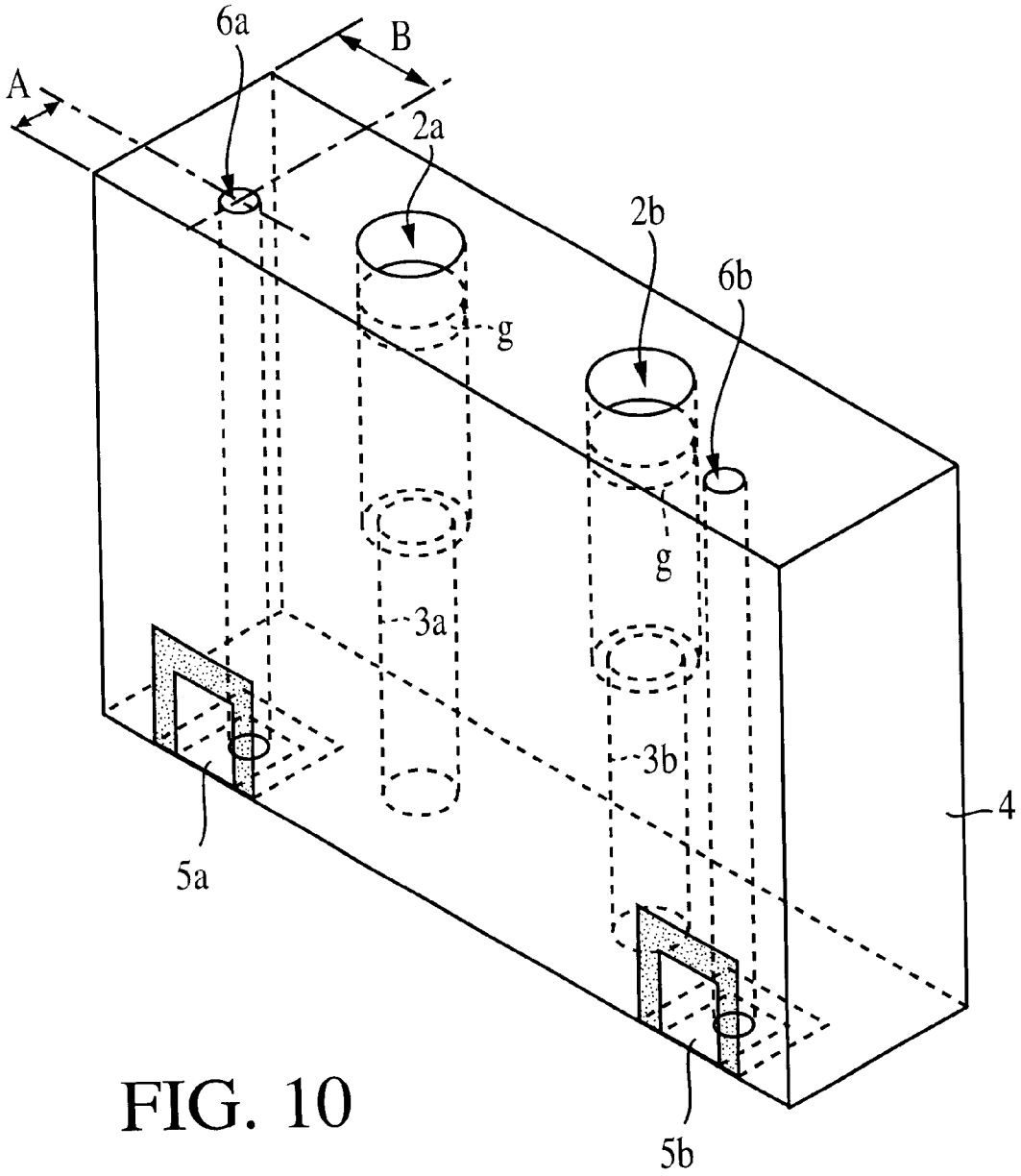
FIG. 10 is a perspective view of the appearance of a dielectric filter according to a sixth embodiment of the present invention.

FIG. 10 is a perspective view of the appearance of a dielectric filter according to a sixth embodiment of the present invention. In this embodiment, stepped holes are used as the inner-conductor-formed holes 2*a* and 2*b* shown in FIGS. 5A and 5B. As shown here, since the inner-conductor-formed holes 2*a* and 2*b* are stepped holes, an axial length necessary to obtain a specified resonance frequency can be changed, although an axial length in the case of straight holes cannot be changed. For example, when the line impedance of each of the open-circuited-end sides is made smaller than that of each of the short-circuited-end sides, the resonance frequency with respect to a coaxial length decreases so that the axial length to obtain a specified resonance frequency can be shortened. As a result, the $TE_{101}$-mode resonance frequency is shifted to the higher-frequency side. However, when the dimension B is increased, for example, the $TE_{101}$-mode resonance frequency can be shifted to a frequency side lower than the second-order harmonic $2f_0$ of the central frequency $f_0$ of a pass band. In contrast, when the line impedance of the short-circuited-end side is made smaller than that of the open-circuited-end side, the resonance frequency with respect to the coaxial length rises, and the axial length to obtain a specified resonance frequency increases. As a result, the $TE_{101}$-mode resonance frequency can be shifted to the lower frequency side.

Next, a description will be given of the structure of a dielectric duplexer with reference to FIGS. 11 to 13.

Figure 11:
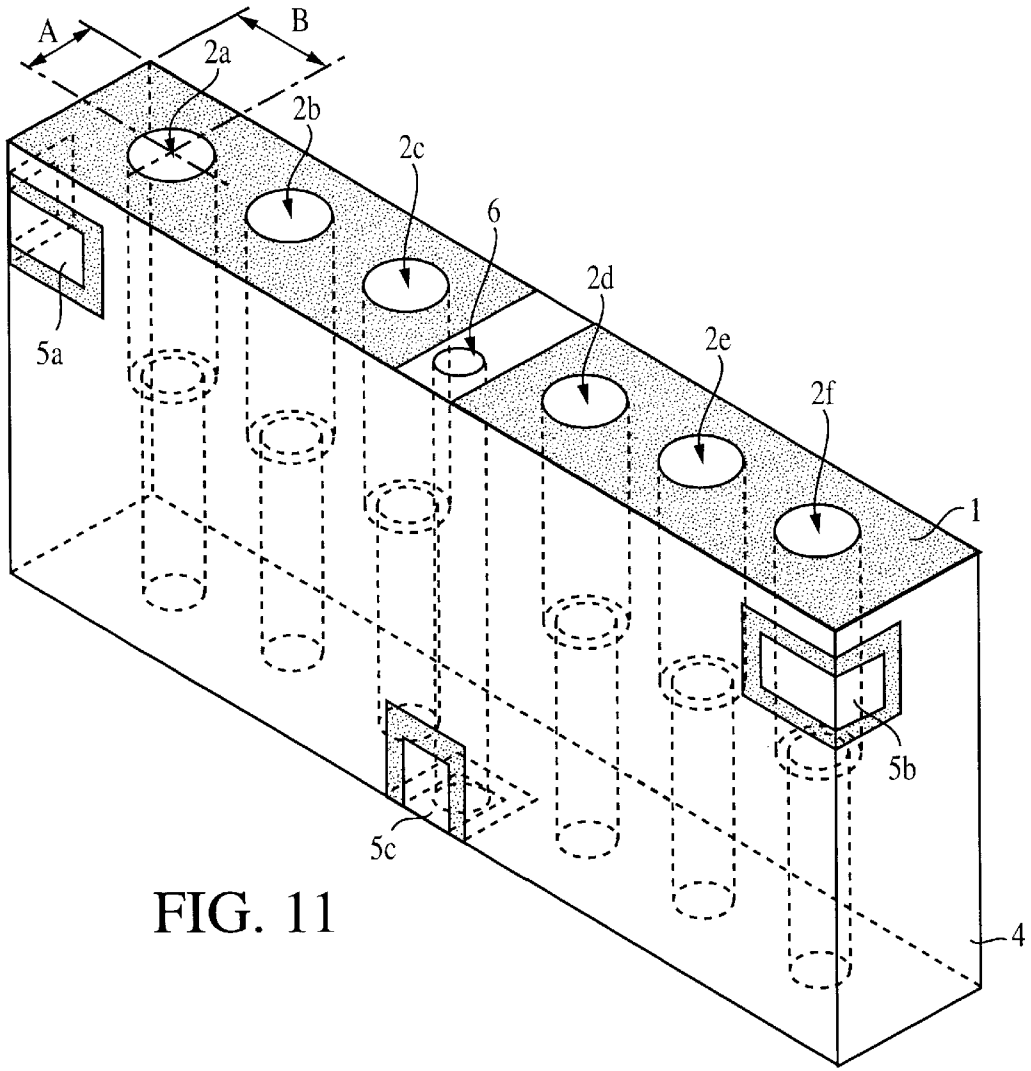
FIG. 11 is a perspective view of the appearance showing the structure of a dielectric duplexer according to a seventh embodiment of the present invention.

In the embodiment shown in FIG. 11, inside a dielectric block 1, inner-conductor-formed holes 2*a* to 2*f* and an excitation hole 6 having inner conductors formed on the inner surfaces thereof are disposed. An outer conductor 4 is formed on each of the external surfaces of the dielectric block 1. One end of each of the inner conductors formed on the inner surfaces of the inner-conductor-formed holes 2*a* to 2*f* is connected to the outer conductor 4, and the other end thereof is open-circuited at an open face. One end of the excitation hole 6 is connected to the outer conductor 4, and the other end thereof is connected to an input/output electrode 5C. In addition, on the external surfaces of the dielectric block 1, input/output electrodes 5*a* and 5*b* are formed in such a manner that the electrodes 5*a* and 5*b* are isolated from the outer conductors 4. A capacitance is generated between the electrodes 5*a* and 5*b* and the vicinities of the open-circuited ends of the inner conductors formed on the inner surfaces of the inner-conductor-formed holes 2*a* and 2*f*.

With this arrangement, the three-stage resonator comprised of the inner-conductor-formed holes 2*a* to 2*c* permits band-pass characteristics to be generated between the input/output electrode 5*a* and the input/output electrode 5*c*. In this situation, the input/output electrode 5*a* serves as a transmission signal input terminal, and the input/output electrode 5c serves as an antenna terminal. In addition, the three-stage resonator comprised of the inner-conductor-formed holes 2*d* to 2*f* permits band-pass characteristics to be generated between the input/output electrode 5*c* and the input/output electrode 5*b*. In this situation, the input/output electrode 5*c* serves as an antenna terminal, and the input/output electrode 5*b* serves as a reception signal output terminal.

Similarly, in such a dielectric duplexer, the distance B from the center of each of the outermost inner-conductor-formed holes 2*a* and 2*f* to each of the widthwise lines of the dielectric block is two times or greater than the distance A from the center of each of the holes 2*a* and 2*f* to each of the lengthwise lines thereof.

Figure 12:
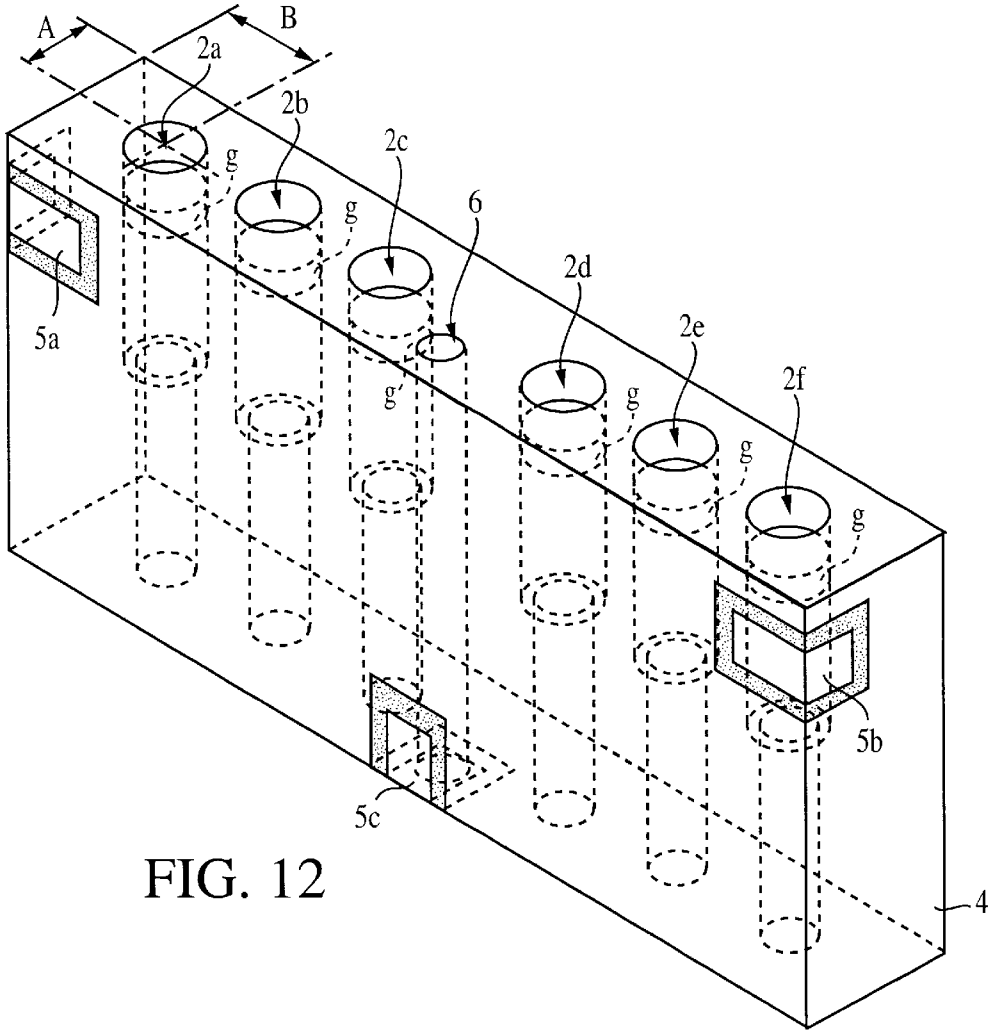
FIG. 12 is a perspective view of the appearance showing the structure of a dielectric duplexer according to an eighth embodiment of the present invention.

In the embodiment shown in FIG. 12, on each of the external six surfaces of a dielectric block, an outer conductor 4 is formed. The outer conductor 4 is connected to one end of each of inner conductors formed on the inner surfaces of inner-conductor-formed holes. The other end of thereof is open-circuited at a non-inner-conductor-formed portion g. The other structural parts are the same as those shown in FIG. 11.

Figure 13:
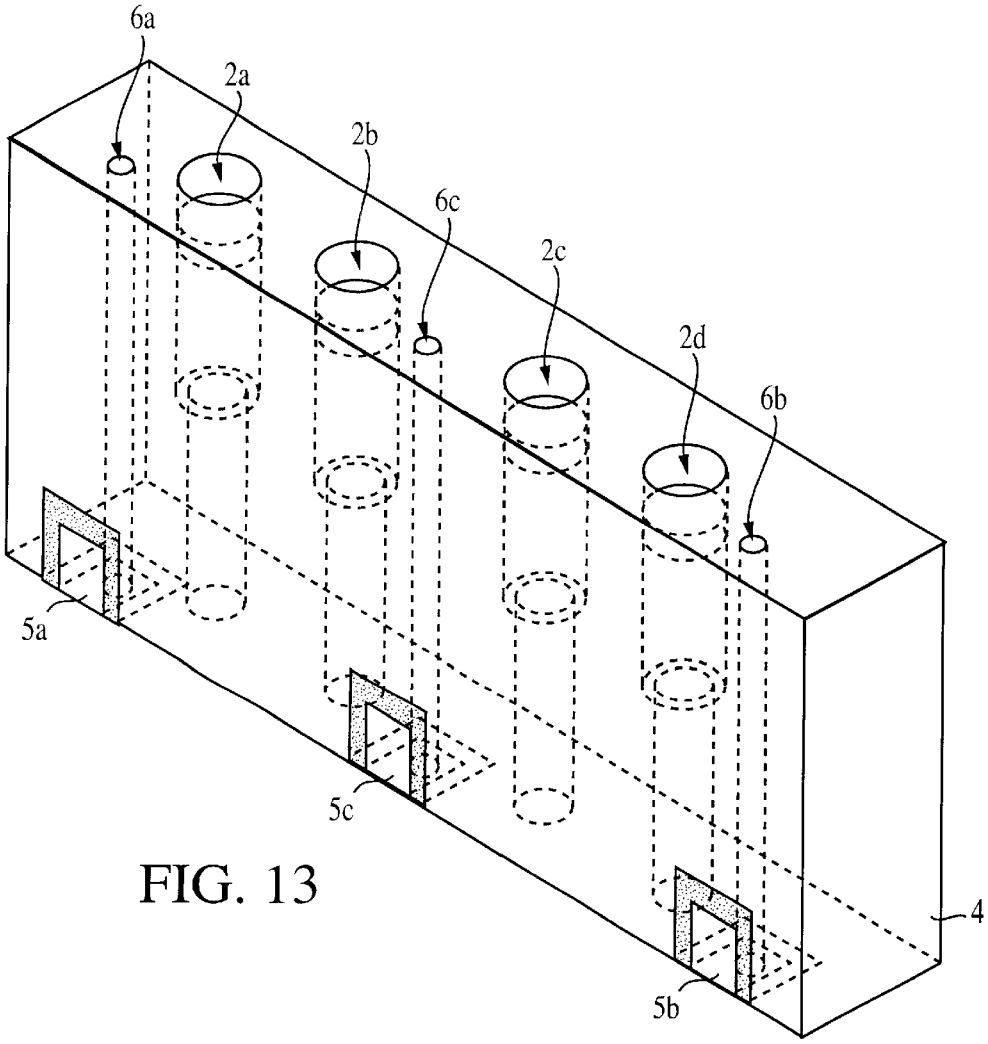
FIG. 13 is a perspective view of the appearance showing the structure of a dielectric duplexer according to a ninth embodiment of the present invention.

In the embodiment shown in FIG. 13, in a dielectric block, inner-conductor-formed holes 2*a* to 2*d* and excitation holes 6*a* to 6*c* having inner conductors formed on the inner surfaces thereof are disposed. On the external surfaces of the dielectric block, input/output electrodes 5*a* to 5*c* isolated from an outer conductor 4 are formed, and one end of each of the excitation holes 6*a* to 6*c* is connected to the input /output electrodes 5*a* to 5*c*, respectively. In this arrangement, the excitation holes 6*a* and 6*c* are interdigitally coupled with resonators comprised of the inner-conductor-formed holes 2*a* and 2*b*, respectively, and the excitation holes 6*c* and 6*b* are interdigitally coupled with resonators comprised of the inner-conductor-formed holes 2*c* and 2*d*, respectively.

With this arrangement, the two-stage resonator comprised of the inner-conductor-formed holes 2*a* and 2*b* permits pass-band characteristics to be generated between the input/output electrodes 5*a* to 5*c*, and the input/output electrode 5*a* serves as a transmission signal input terminal, and the input/output electrode 5*c* serves as an antenna terminal. In addition, the two-stage resonator comprised of the inner-conductor-formed holes 2*c* and 2*d* permits pass-band characteristics to be generated between the input/output electrodes 5*c* to 5*b*, and the input/output electrode 5*c* serves as an antenna terminal, and the input/output electrode 5*b* serves as a reception signal input terminal.

Similarly, in such a dielectric duplexer, the distance B from the center of each of the outermost excitation holes 6*a* and 6*b* to each of the widthwise lines of the dielectric block is two times or greater than the distance A from the center of each of the holes 6*a* and 6*b* to each of the lengthwise lines thereof.

Next, a description will be given of the structure of a communication apparatus using one of the dielectric filter and the dielectric duplexer with reference to FIG. 14. In this figure, reference character ANT denotes a transmission/reception antenna, reference character DPX denotes a duplexer, reference characters BPFa, BPFb, and BPFc denote band pass filters, reference characters AMPa and AMPb denote amplifying circuits, reference characters MIXa and MIXb denote mixers, reference character OSC denotes an oscillator, and reference character DIV denotes a divider. The MIXa modulates a frequency signal output from the DIV by using a modulation signal. The BPFa permits only the signals of a transmission-frequency band to pass, and the AMPa performs the power-amplification of the passed signals to transmit from the ANT via the DPX. Of the signals output from the DPX, the BPFb permits only the signals of a reception frequency band to pass, and the AMPb amplifies the passed signals. The MIXb performs mixing of the frequency signals output from the BPFc and received signals to output intermediate frequency signals IF.

Figure 14:
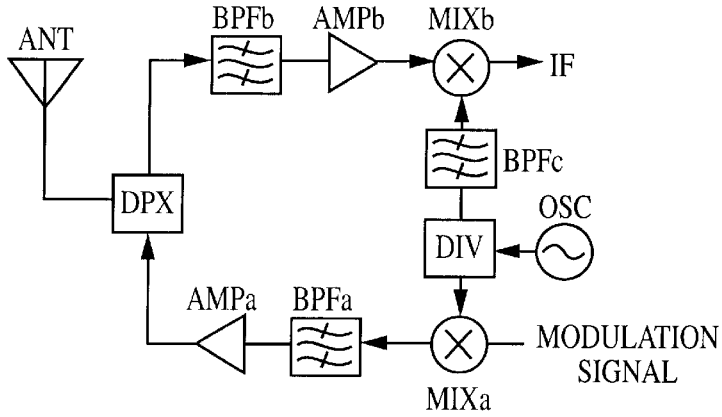
FIG. 14 is a block diagram showing the structure of a communication apparatus of the present invention.
Figure 15A:
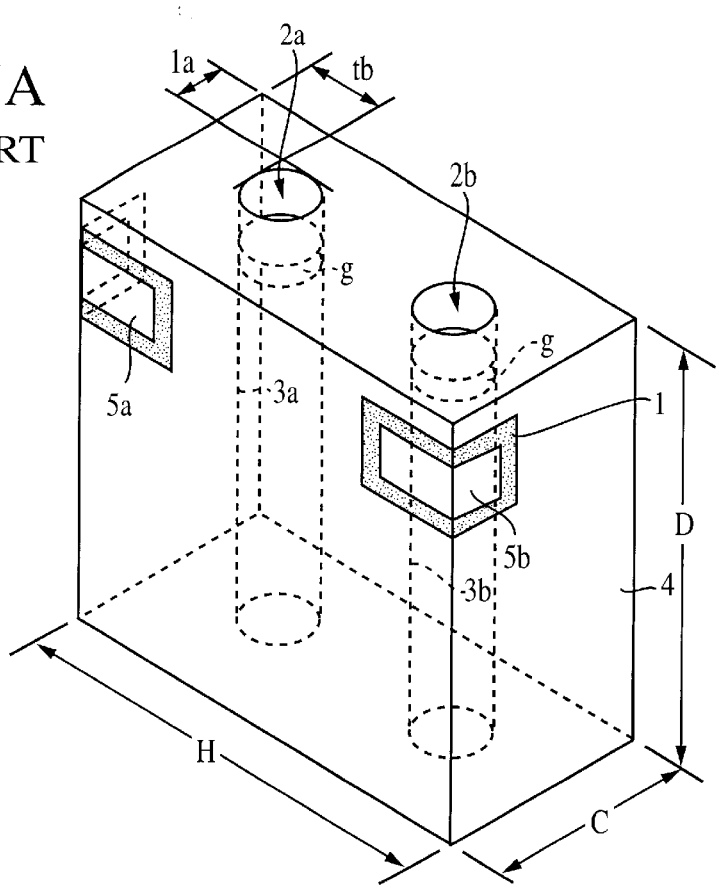
FIG. 15A PRIOR ART
FIG. 15A shows a perspective view of the appearance of a conventional dielectric filter.
Figure 15B:
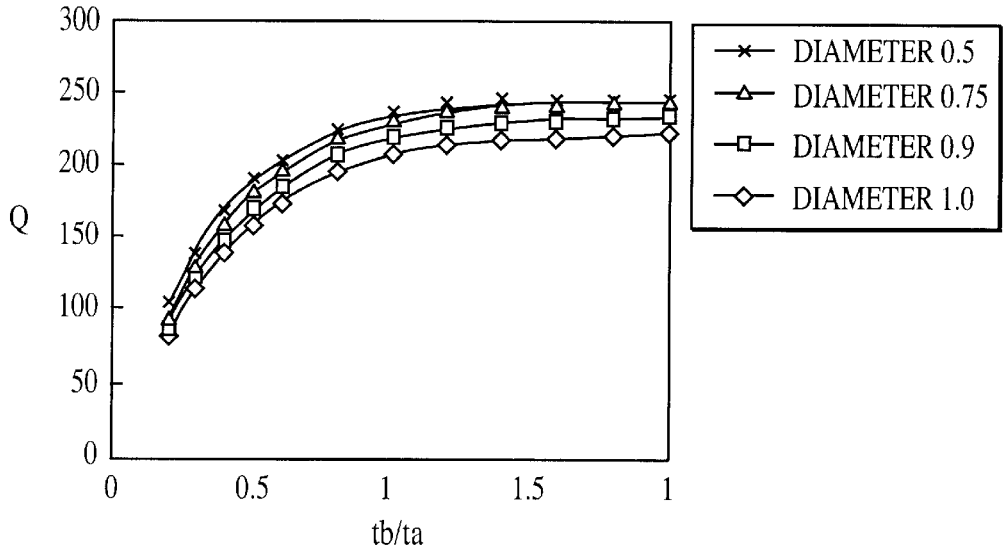
FIG. 15B PRIOR ART
FIG. 15B shows a graph illustrating the relationship between the thickness of an inner-conductor-formed hole and the unloaded Q of a resonator in the dielectric filter.

As the duplexer DPX shown in FIG. 14, the aforementioned dielectric duplexer can be used. In addition, the aforementioned dielectric filter can be used as one of the band-pass filters BPFa, BPFb, and BPFc. In this way, a communication apparatus using one of the dielectric duplexer and the dielectric filter causing no unnecessary spurious-mode responses is obtainable.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

a substantially rectangular-parallelepiped dielectric block;

a plurality of holes formed inside the dielectric block, the holes aligned in parallel with each other along a lengthwise line of the dielectric block;

inner conductors formed on the inner surfaces of the plurality of the holes; and outer conductors formed on external surfaces of the dielectric block;

wherein the distance between the central axis of an outermost hole of the aligned holes and a widthwise line of the dielectric block is set to be two times or more than the distance between the central axis of the outermost hole and a lengthwise line thereof.

2. A dielectric duplexer comprising:

a substantially rectangular-parallelepiped dielectric block;

a plurality of holes formed inside the dielectric block, the holes aligned in parallel with each other along a lengthwise line of the dielectric block;

inner conductors formed on the inner surfaces of the plurality of the holes; and outer conductors formed on external surfaces of the dielectric block;

wherein the distance between the central axis of an outermost hole of the aligned holes and a widthwise line of the dielectric block is set to be two times or more than the distance between the central axis of the outermost hole and a lengthwise line thereof.

3. A communication apparatus comprising the dielectric filter of claim 1.

4. A communication apparatus comprising the dielectric duplexer of claim 2.

* * * * *